US006007175A

United States Patent [19]

Tanahashi

[11] Patent Number: 6,007,175

[45] Date of Patent: Dec. 28, 1999

[54] PICTURE PRINTING METHOD AND DEVICE PRINTING PIXELS IN WHICH COLUMNS OF DOTS ARE PRINTED AT DIFFERENT INTENSITY LEVELS

[75] Inventor: Makoto Tanahashi, Kanagawa, Japan

[73] Assignee: Sony Corporation, Japan

[21] Appl. No.: 08/532,983

[22] Filed: Sep. 22, 1995

[30] Foreign Application Priority Data

Sep. 28, 1994 [JP] Japan ..... 6-233104

[51] Int. Cl.[6] ..... B41J 2/205

[52] U.S. Cl. ..... 347/15

[58] Field of Search ..... 347/15, 19; 358/298, 358/514, 521, 458

[56] References Cited

U.S. PATENT DOCUMENTS 4,032,978 6/1977 Wong ..... 347/15

4,635,078 1/1987 Sakurada et al. ..... 347/15

4,884,080 11/1989 Hirahara et al. ..... 347/172

5,587,728 12/1996 Edgar ..... 347/19

*Primary Examiner*—John Barlow

*Assistant Examiner*—Thien Tran

*Attorney, Agent, or Firm*—Rader, Fishman & Grauer; Ronald P. Kannanen

[57] ABSTRACT

A printing method in which a pixel is resolved into a matrix and the gradation of a picture is variably set by dots printed in each pixel. The method includes a line setting step of setting a print density for lines corresponding to the main scanning direction along which dots are arrayed, and a dot-based printing step of printing dot-by-dot along the main scanning direction based upon line-based print densities set by the line setting step. A picture printing device employing such printing method is also disclosed.

23 Claims, 13 Drawing Sheets

PICTURE PRINTING METHOD AND DEVICE PRINTING PIXELS IN WHICH COLUMNS OF DOTS ARE PRINTED AT DIFFERENT INTENSITY LEVELS

BACKGROUND OF THE INVENTION

This invention relates to a printing method and a picture printing device employing such printing method. More particularly, it relates to a printing method in which a pixel is resolved into a matrix and the gradation of a picture is variably set by dots printed in each pixel, and a picture printing apparatus employing such printing method.

Video reproducing apparatus for reproducing picture signals recorded on a video tape, disc reproducing devices for reproducing picture signals recorded on a disc-shaped recording medium, such as an optical disc or a magneto-optical disc, and or picture reproducing devices for receiving and displaying television signals for outputting the received picture signals, such as a television receiver, are extremely popular in modern society. A picture printing device for printing a picture based on output picture signals of such picture reproducing devices has also been commercialized.

Picture printing devices may be classified into a heat-sensitive type device configured for heating a heat-sensitive sheet using a thermal head, a thermal transfer type in which a printing ribbon is heated using a thermal transfer head for transferring the printing ink from the printing ribbon to the printing sheet, and an ink jet system in which fine ink drops are deposited on the printing sheet.

A pixel 50 printed by the picture printing device is made up of a pre-set number of dots arranged in a 2×4 matrix having a main scanning direction X and an auxiliary scanning direction Y normal to the main scanning direction, as shown for example in FIG. 1.

The gradation of each pixel 50 forming the picture is variably set by printing a pre-set number of dots in each pixel depending upon pixel-based luminance of picture signals supplied from a picture signal input terminal.

With increase in luminance of picture signals, the gradation level of the pixel 50 is variably set by printing the respective dots as shown in FIG. 2 in a sequence indicated in FIG. 1. For gradation 0, no dots are printed, whereas, for gradations 1, 2 and 3, dots of the sequence numbers 1, 2 and 3 are printed, and so forth, until all dots are printed for the gradation 8. Thus, nine gradation levels from gradation 0 to gradation 8 may be displayed.

With the above picture printing device, printing is carried out by a printing head as dots are arranged line-by-line in the main scanning direction X, and the line number is incremented in the auxiliary scanning direction Y, for arraying pixels 50 in a matrix configuration on a printing sheet 60 for forming a picture, as shown in FIG. 3.

If printing is to be performed using a picture printing device of the heat-sensitive or thermal transfer system, in which a printing head is heated, the heat storage effect of the printing head is increased with an increase in the number of adjacent dots of a pixel during printing of these adjacent dots, the result is over printing the result over an area larger than the intended print area.

On the other hand, if printing is to be performed using a picture printing device in accordance with a heat transfer system or an ink jet system in which ink is deposited on a printing sheet, the effect of ink flowing and blending into adjacent ink drops is increased with an increase in the number of adjacent dots. Again, the result is printing over an area larger than the intended print area.

Thus an inconvenience arises in that an increase in the print density conflicts with sharply defined luminance of the picture signals. The result is that printing cannot be achieved with high print density and faithful reproduction of the gradations in the picture signals.

OBJECT AND SUMMARY OF THE INVENTION

It is therefore an object of the present invention to provide a printing method in which print density may be increased linearly with a concurent increase in the luminance of the picture signals for achieving printing with print density which is still faithful to the luminance of the picture signals, and a picture printing device utilizing such printing method.

According to the present invention, there is provided a printing method including a line setting step of setting a print density for lines corresponding to the main scanning direction along which dots are arrayed, and a dot-based printing step of printing dot-by-dot along the main scanning direction based upon line-based print densities as set by the line setting step.

With the printing method of the present invention, dot-based printing may be achieved by the printing step based upon line-based print densities as set by the line setting step.

Thus the dots may be prohibited from flowing into adjacent dots despite increase in the number of printed dots. Since printing may be done in this manner for an area closer to the intended printing area, the print density is increased rectilinearly with increase in the number of dots printed for one pixel, so that printing may be achieved with the present printing method with a print density more faithful to the luminance of picture signals.

According to the present invention, there is also provided a picture printing apparatus including dot setting means for setting line-based print densities of a pre-set number of dots printed along the main scanning direction based upon picture signals supplied through a picture signal input terminal, and printing means for printing the dots as set by the dot setting means in accordance with the line-based print density while scanning is done in the main scanning direction. The dots are arrayed in a matrix configuration in a main scanning direction and in an auxiliary scanning direction perpendicular thereto and are designed to change the gradation depending on whether the dots are printed or are not printed.

With the printing apparatus of the present invention, printing may be achieved by the printing unit based upon dots in each pixel as set by dot setting means and line-based print densities.

Thus the dots may be prohibited from flowing into adjacent dots despite an increase in the number of printed dots. Since printing may be done in this manner for an area closer to the intended printing area, the print density is increased rectilinearly with an increase in the number of dots printed for one pixel, so that printing may be achieved with the present printing apparatus with a print density more faithful to the luminance of the picture signals.

DESCRIPTION OF THE PREFERRED EMBODIMENTS

Figure 1:
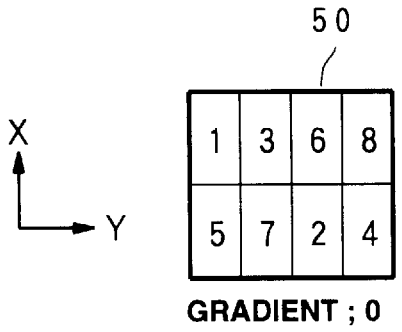
FIG. 1 shows an array of dots for respective gradients of each pixel printed by a conventional picture printing device or an inventive picture printing device, with the pixels being arranged in a 2×4 matrix.
Figure 2:
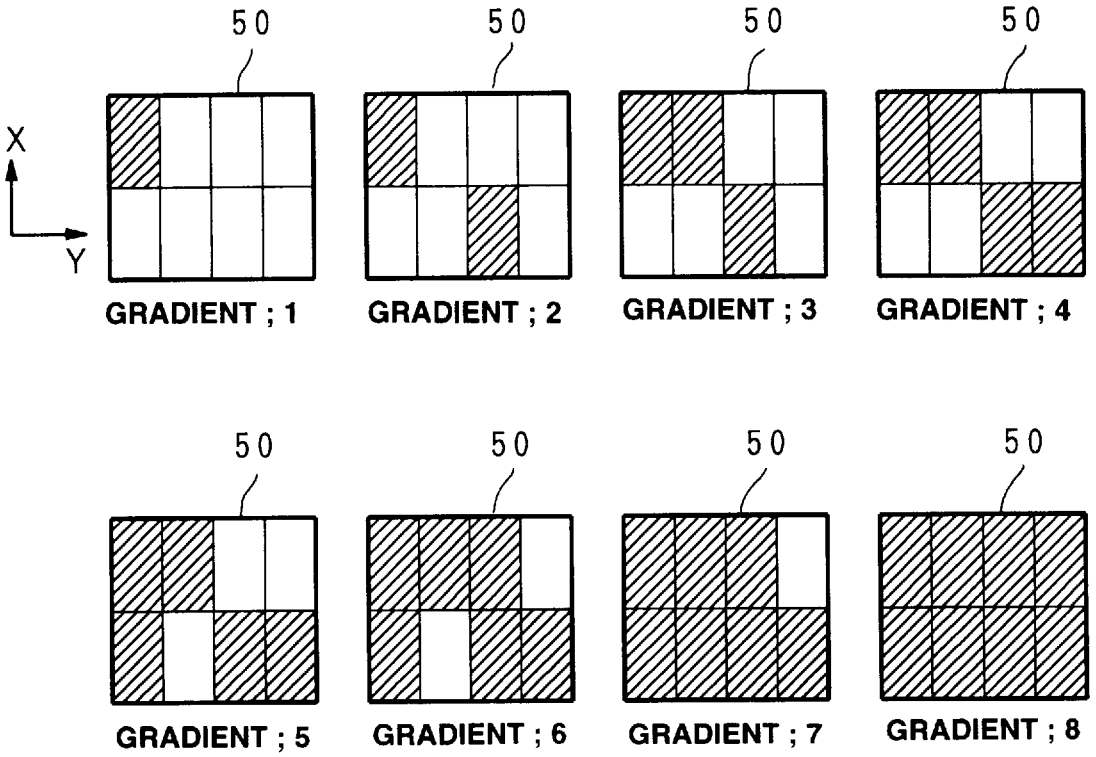
FIG. 2 shows an array of dots for respective gradations of each pixel printed by a conventional picture printing device, with the pixels being arranged in a 2×4 matrix.

Referring to the drawings, preferred embodiments of the present invention will be explained in detail.

The printing method is carried out by the picture printing method described above.

Figure 4:
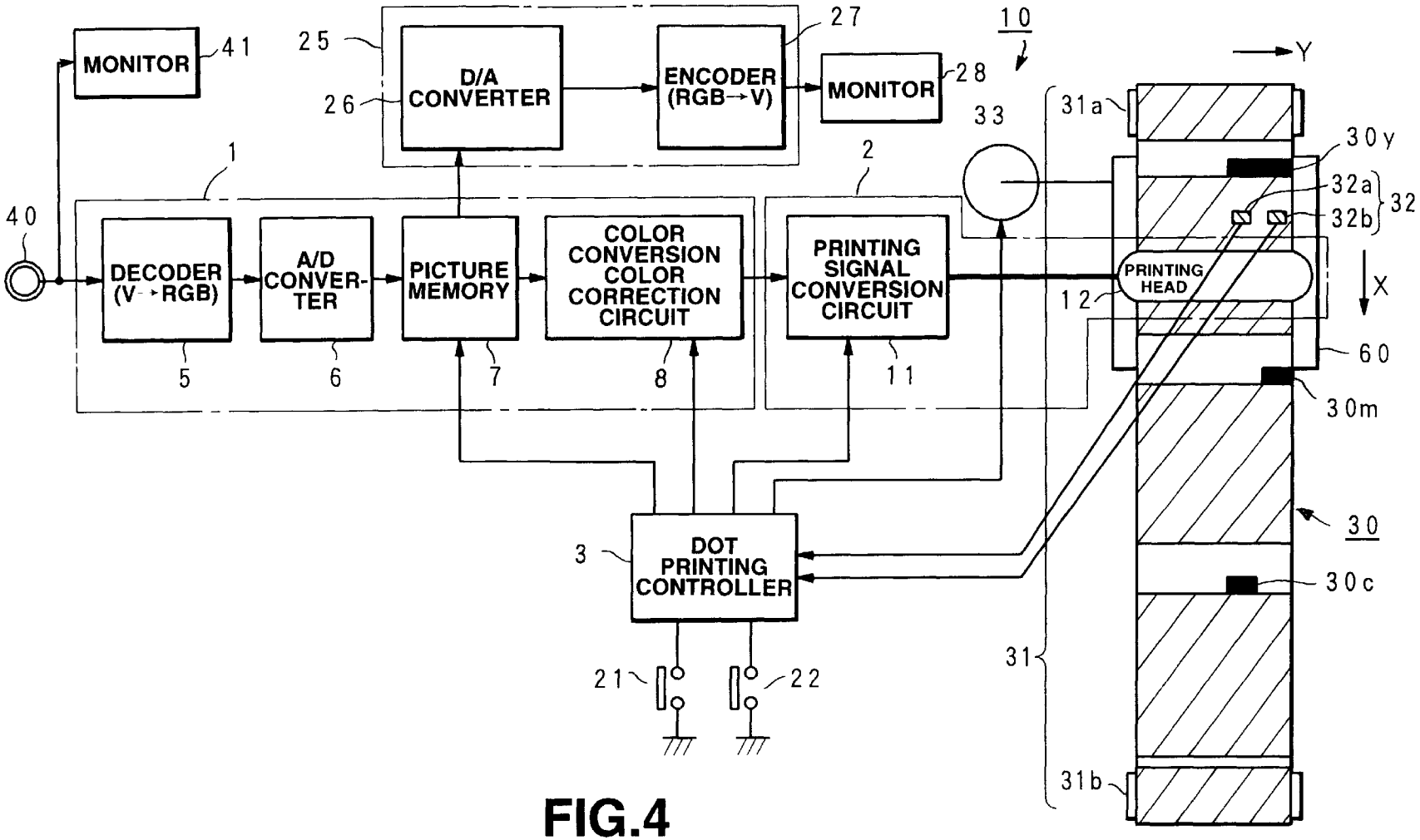
FIG. 4 is a block diagram of a picture printing device for carrying out the printing method according to the present invention.

Referring to FIG. 4, the picture printing device is a picture printing device 10 of the thermal transfer type, and includes a dot setting unit 1 for setting printing dots and line-by-line print density based upon picture signals supplied from a picture signal input terminal 40, and a printing unit 2 for printing the dots as set by the dot setting unit 1 based upon the line-by-line print density while effecting scanning in the main scanning direction X. The picture printing device 10 also includes a dot printing controller 3 for controlling the start of the operation of the dot setting unit 1 and the printing unit 2 and switches 21, 22 for setting the start of the operation of the dot print controller 3. The picture printing device 10 also has an exit picture signal generator 25 for converting picture signals for printing into exit picture signals and a monitor 28 for displaying a picture based upon the exit picture signals. The picture printing device also includes a ribbon take-up unit 31 for taking up a color ink ribbon 30 from which heat transfer is to be performed by a printing head 12 of the printing unit 2. The picture printing device finally includes a YMC detection unit 32 for detecting the color of the color ink ribbon 30 for effecting printing by the printing unit 2 and a sheet feed unit 33 for shifting a printing sheet 60 in synchronism with the printing of the printing unit 2. The picture reproducing apparatus displays the picture on a monitor 41 based upon picture signals supplied to the picture signal input terminal 40.

The dot setting unit 1 includes a decoder 5 for converting the picture signals supplied from the picture signal input terminal 40 to RGB signals, and an A/D converter 6 for converting the RGB signals supplied from the decoder 5 into digital RGB signals. The dot setting unit 1 also includes a picture memory 7 for storing the digital RGB signals and a color conversion and color correction circuit 8 for converting the digital RGB signals supplied to the picture memory 7 into YMC signals, that is yellow (Y), magenta (M)=R-Y and cyan (C)=B-Y signals, and for correcting the chromaticity.

When a "store signal" is supplied from the dot print controller 3, the dot setting unit 1 causes the digital RGB signal to be stored in the picture memory 7. When a "transfer signal" is supplied from the dot print controller 3, the dot setting unit 1 causes the digital RGB signals stored in the picture memory 7 to be converted by the color conversion and color correction circuit 8 into YMC signals and to be corrected for chromaticity corresponding to the luminance of each color, before transferring the signals to the printing unit 2.

Figure 5:
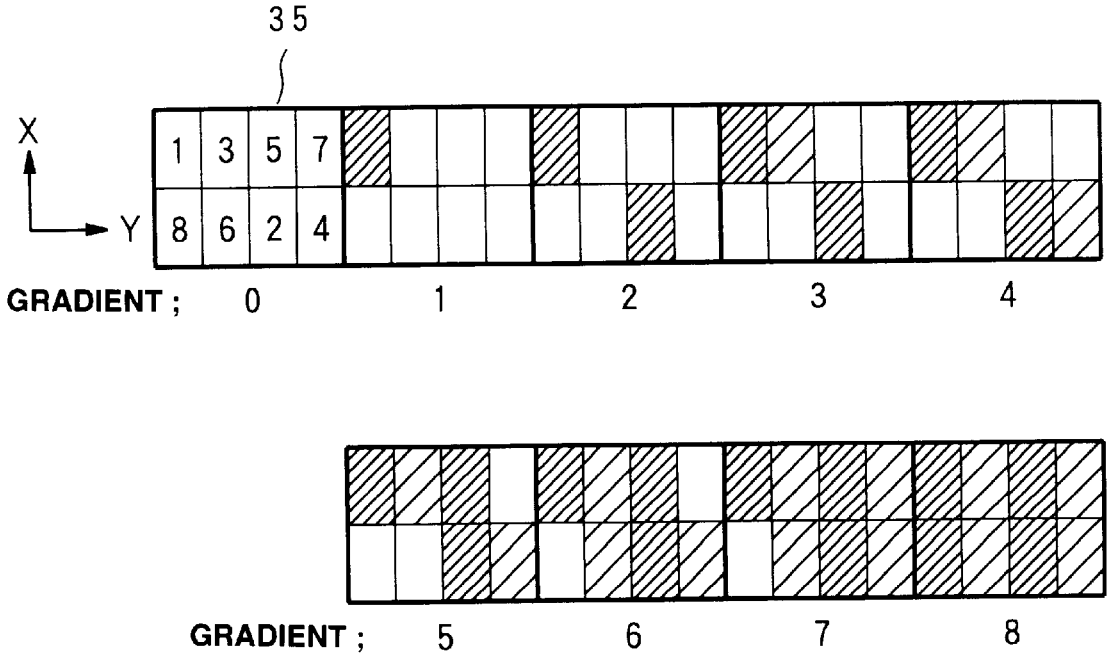
FIG. 5 shows an array of dots for each gradation of a pixel printed by the picture printing device shown in FIG. 4, in which the print density is variably set line-by-line and each pixel is formed by a 2×4 matrix.

Each dot is printed in accordance with the sequence shown in the pixel 35 of a gradation level 0 shown in FIG. 5, with increase in the color-based luminance of the picture signals, with an odd-numbered line being of a standard density and an even-numbered line being of a density of 80% of the standard density, for realizing variable setting of the gradation level. If each pixel 35 is made up in this manner of eight dots, nine stages of gradation levels of from gradation 0 to gradation 8 may be displayed, such that, with three colors, 9×9×9=729 gradation levels may be displayed.

Figure 3:
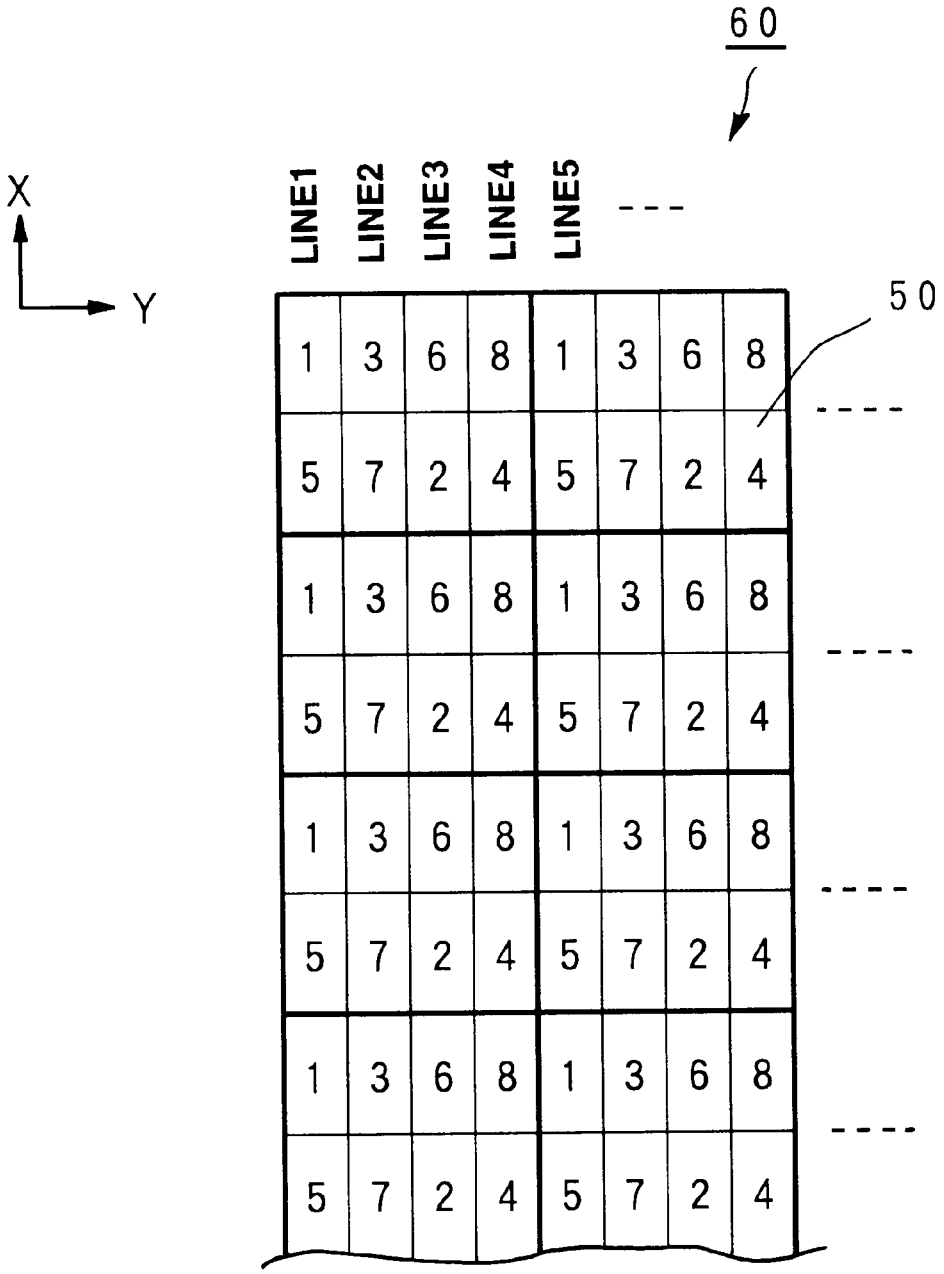
FIG. 3 shows pixels arrayed in a 2×4 matrix for printing n a printing sheet by a conventional picture printing device or an inventive picture printing device.

With the above-described picture printing device, printing is carried out using a printing head as described in connection with FIG. 3 by arraying dots in each line in the main scanning direction and by increasing the line number along the auxiliary scanning direction, for arraying the pixels 35 in a matrix configuration on a printing sheet for forming a picture. The line-based print density may be set by varying the pulse duty of strobe signals SR1, SR2, SR3 and SR4 supplied to the printing head 12 of the printing unit 2 which will be explained subsequently.

The printing unit 2 includes a printing signal converting circuit 11 for converting the YMC signals, corrected for chromaticity by the color conversion and color correction circuit 8, into printable printing signals, and a printing head 12 for effecting printing in accordance with the printing signals. The YMC signals are converted from the digital RGB signals previously stored in the picture memory 7 of the dot setting unit 1 when the "transfer signal" is supplied to the dot setting unit 1 from the dot print controller 3 as described previously.

The print signal converting circuit 11, which forms each pixel 35 from eight dots, arrayed in a 2×4 matrix in the main scanning direction X and in the auxiliary scanning direction Y, as shown in FIG. 5, has pre-set therein the dots to be printed for each chromaticity of each pixel 35 and the line-based print density of the dots arrayed in the main scanning direction X, in accordance with picture signals supplied from the color conversion color correction circuit 8 of the dot setting unit 1, and varies the gradation in accordance with the dot-based and line-based print density.

Figure 6:
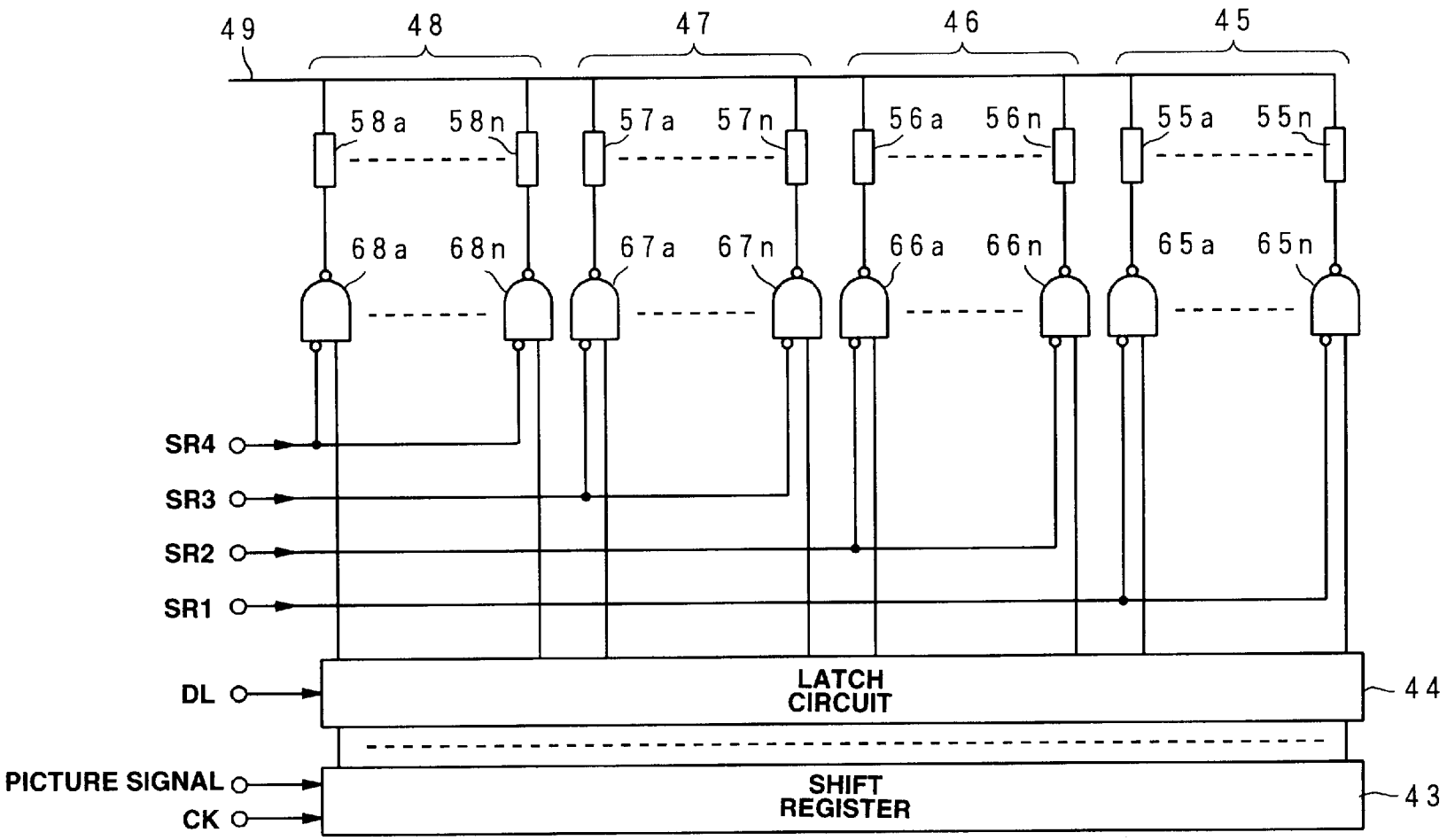
FIG. 6 is a block diagram of essential portions of a printing unit 2 of the picture printing device.

Referring to FIG. 6, the printing head 12 includes a shift register 43 for shifting picture signals supplied in synchronism with clock signals CK from the printing signal conversion circuit 11, and a latch circuit 44 for storing picture signals supplied to the shift register 43 each time a data latch signal DL is supplied. The printing head 12 also includes heating units 45, 46, 47 and 48 arrayed in the line direction so as to be heated for heat transfer each time the strobe signals SR1, SR2, SR3 and SR4 are supplied, and a common electrode 49 connected to one ends of resistance heaters of the heating units 45 to 48.

The heating unit 45 includes the resistance heaters 55*a* to 55*n*, arrayed in association with respective dots. The resistance heaters 55*a* to 55*n* have heat transfer capability in the main scanning direction X and have one end connected to the common electrode 49. NAND circuits 65*a* to 65*n* have output terminals are connected to the other ends of the resistance heaters 55*a* to 55*n*. The input terminals of the NAND circuits 65*a* to 65*n* are fed with respective dots of the picture signals from the latch circuit 44 and with inverted signals of the strobe signal SR1, respectively.

The heating temperature of the heating resistors 55*a* to 55*n* of the heating unit 45 may be variably set by variably setting the pulse duty of the strobe signal SR1.

Similarly the heating units 46, 47 and 48 respectively include the resistance heaters 56*a* to 56*n*, 57*a* to 57*n* and 58*a* to 58*n*, arrayed in association with respective dots with heat transfer capability in the main scanning direction X and having one end connected to the common electrode 49, and NAND circuits 66*a* to 66*n*, 67*a* to 67*n* and 68*a* to 68*n* whose output terminals are connected to the other ends of these resistance heaters. The input terminals of the NAND circuits 66*a* to 66*n*, 67*a* to 67*n* and 68*a* to 68*n* are fed with respective dots of the picture signals from the latch circuit 44 and inverted signals of the strobe signals SR2, SR3 and SR4, respectively.

The heating temperature of the heating resistors 56*a* to 56*n*, 57*a* to 57*n* and 58*a* to 58*n* of the heating units 46, 47 and 48 may be variably set by variably setting the pulse duty of the strobe signals SR2, SR3 and SR4.

Figure 7:
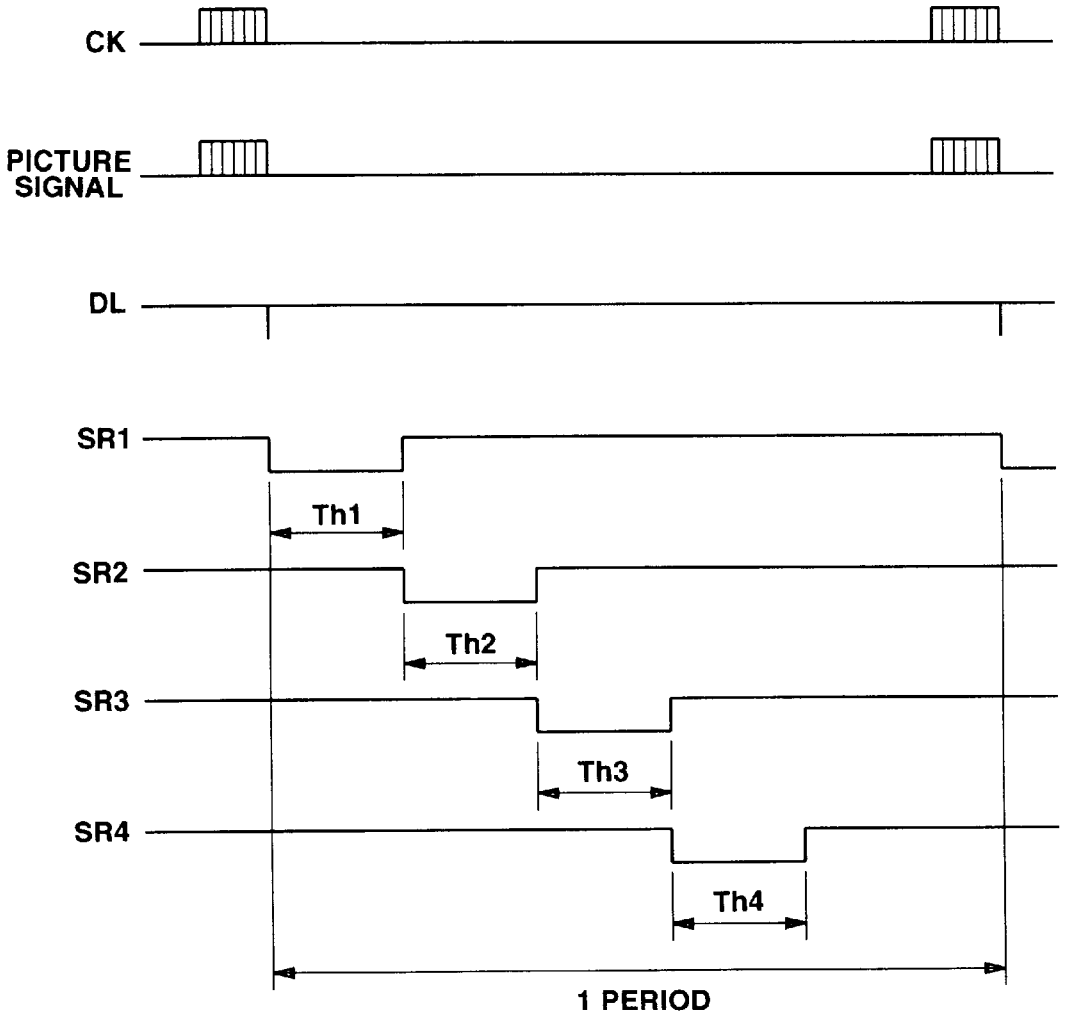
FIG. 7 is a timing chart showing essential parts of the printing unit 2 of the picture printing device.

In the printing head 12, there is produced a phase difference in the pulses of the strobe signals SR1, SR2, SR3 and SR4 for decreasing the maximum power applied to the heating units 45, 46, 47 and 48, as shown in FIG. 7. It is also passible to generate the pulses of the strobe signals SR1, SR2, SR3 and SR4 simultaneously and to variably set the duty of the respective strobe signals.

Figure 8:
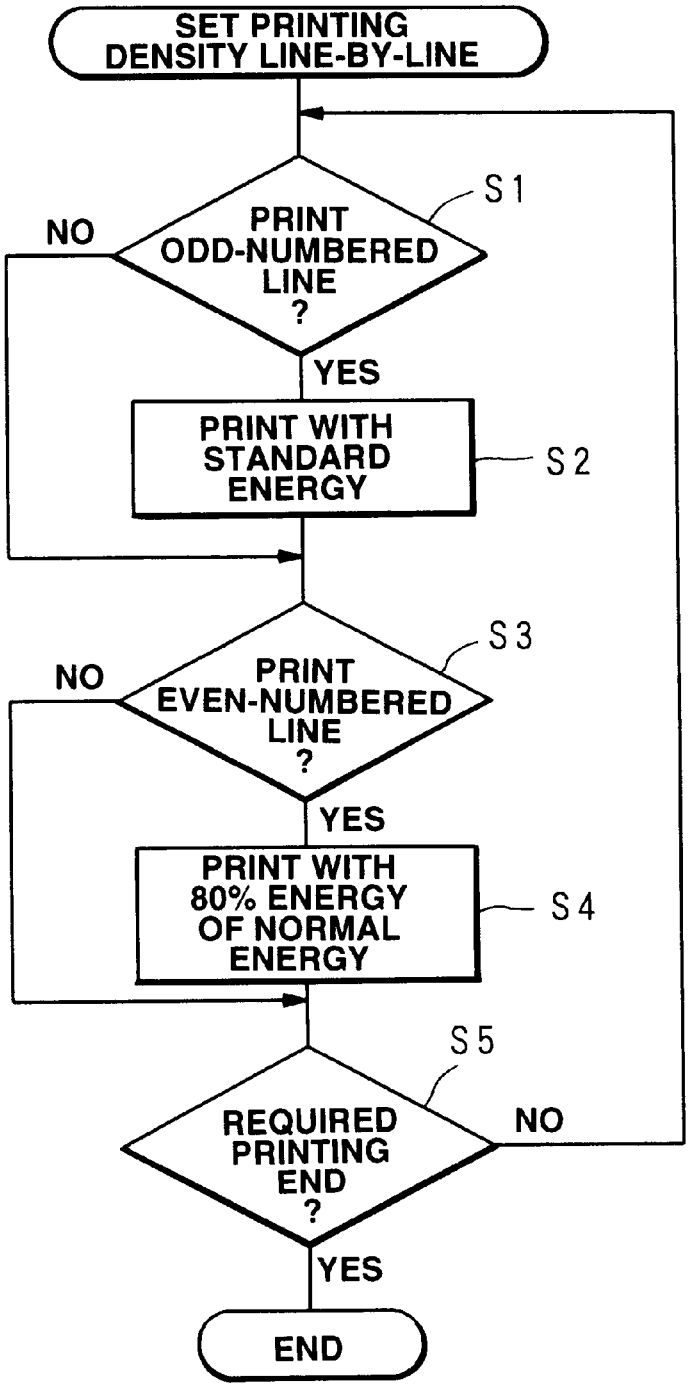
FIG. 8 is a flow chart for illustrating the operation of a line setting step of the printing method according to the present invention.

Referring to FIG. 8, the operation of variably setting the line-based print density by variably setting the duty of the pulses of the strobe signals SR1, SR2, SR3 and SR4 during printing will now be explained.

At step S1, it is judged by the dot print controller 3 whether or not the line printed by the printing head 12 of the printing unit 2 is an odd-numbered line. If the result is YES, that is if the line is an odd line, the dot print controller 3 transfers to step S2 and, if the result is NO, that is if the line is an even line, the dot print controller 3 transfers to step S3.

At step S2, the pulse duty of the strobe signal is set to a standard value to supply the energy of the standard power to the heating units 45 to 48 for effecting printing at a standard density.

At step S3, it is judged by the dot print controller 3 whether or not the line printed by the printing head 12 of the printing unit 2 is an even-numbered line. If the result is YES, that is if the line is an even line, the dot print controller 3 transfers to step S4 and, if the result is NO, that is if the line is an odd line, the dot print controller 3 transfers to step S5.

At step S4, the pulse duty of the strobe signal is set to 80% of the standard value to supply the energy equal to 80% of the standard power to the heating units 45 to 48 for effecting printing at 80% of the standard density.

At step S5, it is judged whether or not printing has come to an end. If the result is YES, that is if the printing has come to an end, the program is terminated. If the result is NO, that is if the program has not come to an end, the controller reverts to step S1.

By setting the line-based print density at the color conversion and color correction circuit 8 and by variably setting the duty of the pulses of the strobe signal SR1, SR2, SR3 and SR4, it becomes possible to print by the printing head of the printing unit 2 with a standard print density for every odd line and with 80% of the standard printing density for every even line.

Figure 9:
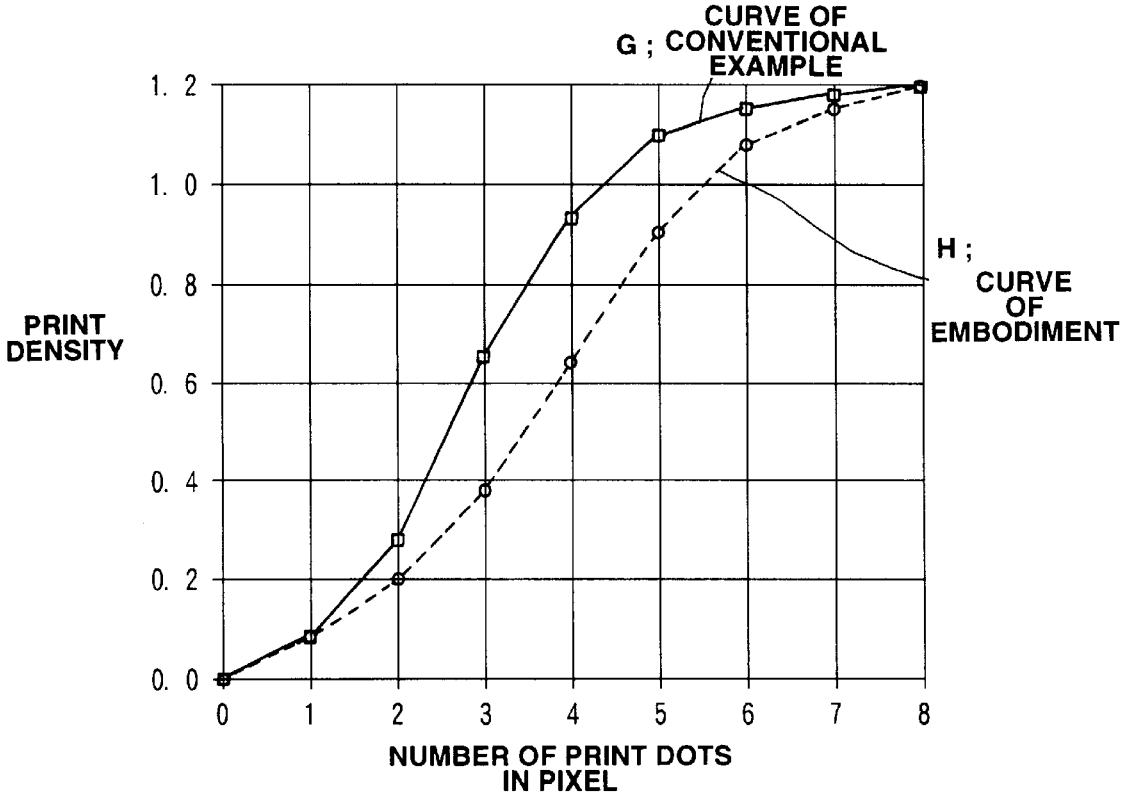
FIG. 9 is a graph showing characteristics of the print density relative to the number of printing dots for one pixel, wherein a curve H is for a pixel printed by the picture printing device according to the present invention and a curve G is a curve for a pixel printed by the conventional picture printing method.

Thus the effect of heat accumulation at the printing head may be suppressed even although the number of adjacent dots is increased. Besides, the effect of mixing of adjacent ink dots may also be suppressed. The result is that printing is performed on an area substantially close to the intended printing area and a linear print density with respect to the number of dots printed in one pixel becomes substantially rectilinear as shown by a curve H in FIG. 9. Thus it becomes possible to the effect printing with a print density faithful to chromaticity of the picture signals.

The dot print controller 3 includes by a micro-computer so that, when the operation of the dot print controller 3 is initiated by the switches 21, 22, the dot print controller 3 controls the operation of the dot setting unit 1 and the printing unit 2, judges the color of printing by the color ink ribbon 30 based upon the results of detection by the YMC detection unit 32 and transmits the picture signal associated with the color from the picture memory 7 of the dot setting unit 1 to the color conversion and color correction circuit 8 in order to control the operation of color-based printing by the printing head 12 of the printing unit 2.

When the switch 21 is closed, the dot print controller 3 transmits the "storage signal" to the dot setting unit 1. When the switch 22 is closed, the dot print controller 3 transmits the "transmit signal" to the dot setting unit 1 and to the printing unit 2.

The switches 21, 22 are separately connected so that it may be detected by the dot printing controller 3 whether or not respective buttons thereof are pressed to closed the switches.

The user of the picture printing device 10 presses the button of the switch 21, as he or she views the picture displayed on the monitor 41, in order for the dot print controller 3 to send out the "storage signal" to the dot setting unit 1.

The user of the picture printing device 10 views the picture displayed on the monitor 41 and presses the button associated with the switch 21 when the desired picture is displayed. This causes the "storage signal" to be transmitted from the dot print controller 3 to the dot setting unit 1.

The user of the picture printing device 10 also views the picture displayed on the monitor 28 in order to judge whether or not picture signals of a picture desired to be printed on the picture memory 7 of the dot setting unit 1 have been stored is the picture memory 7 of the dot setting unit 1, and presses the button associated with the switch 22 when he or she judges that the picture signals have been stored in the picture memory 7. This causes the "transfer signal" to be transmitted from the dot print controller 3 to the dot setting unit 1 and to the printing unit 2.

The exit picture signal generator 25 includes a D/A converter 26 for converting the digital RGB signals, converted from the picture signals and stored in the picture memory 7 of the dot setting unit 1, into analog RGB signals, and an encoder 27 for converting the picture signals supplied from the D/A converter 26 as the analog RGB signals into exit pictures for display.

Depending upon the design statements of the picture reproducing apparatus and the picture printing device 10, the monitors 41, 28 may be constituted by two independent CRTs, by a sole CRT capable of simultaneously displaying two pictures, or by a sole CRT configured for switching from a picture derived from picture signals supplied from the picture signal input terminal 40 to a picture derived from picture signals stored in the picture memory 7 of the dot setting unit 1 at the time of pre-print picture check.

The ribbon take-up unit 31 includes a take-up driving section 31*a* for taking up the color ink ribbon 30 coiled in a roll at a pre-set speed in the main scanning direction X, and a ribbon reel-out section 31*b* for reeling out the color ink ribbon 30 to the take-up driving section 31*a*.

The color ink ribbon 30, taken up on this ribbon take-up unit 31, is divided into color areas of "Y", "M" and "C" or into "Y", "M", "C" and "black", and is provided with color discrimination marks 30*y*, 30*m* and 30*c*, for effecting color-based thermal transfer by the heating in the heating units 45, 46, 47 and 48 in the printing head 12 of the heating unit 2. The color discrimination marks 30*y*, 30*m* and 30*c* are provided in the vicinity of the associated color areas for enabling the respective colors to be discriminated by the YMC detection unit 32.

For example, 2-bit discrimination bits of (1,1) are formed in the color discrimination mark 30*y* so as to be read out by the YMC detection unit 32. Similarly, discrimination signals (1,0) and (0,1) are formed in the color discrimination marks 30*m* and 30*c*, respectively.

The YMC detection unit 32 includes first and second YMC sensors 32*a*, 32*b* for supplying the results of detection of the color discrimination marks 30*y*, 30*m* and 30*c* of the color ink ribbon 30 to the dot print controller 3.

For example, the first and second YMC sensors 32*a*, 32*b* are configured for reading out one different side bits of the two bits of the discrimination signals formed in the color discrimination marks 30*y*, 30*m* and 30*c*.

With the above-described picture printing device 10, the user of the picture printing device 10 views the picture displayed on the monitor 41, and presses the button of the switch 21 when the picture desired to be printed is displayed. At this time, the dot print controller 3 sends out the "storage signal" from the dot print controller 3 to the dot setting unit 1. The dot setting unit 1 then stores the picture signals converted into digital RGB signals in the picture memory 7 and sends out the desired picture to the monitor 28 by the exit picture signal generator 25 based upon the stored picture signals.

The user then views the picture displayed on the monitor 28 and checks as to whether the picture is the one desired to be printed. If the user judges that the picture is one desired to be printed, he or she presses the button of the switch 22. The picture printing unit 10 then causes the dot print controller 3 to send out a "transfer signal" to the dot setting unit 1 and the printing unit 2 for converting and the digital RGB signals stored in the picture memory 7 of the dot printing unit 1 into YMC signals and for carrying out color correction by the color conversion and color correction circuit 8. The resulting picture signals are then transferred to the printing unit 2 for carrying out printing with respective colors of the color ink ribbon 30 based upon print signals derived from the transferred picture signals by the printing unit 2.

Thus, by setting the line-based print density by the color conversion and color correction circuit 8 for adjusting the print density line-by-line, it becomes possible to suppress the effect of heat storage in the printing head or the effect of ink flowing into an adjacent area even although the number of adjacent dots is increased. Thus it becomes possible to effect the printing for an area close to the intended printing area and hence to realize a print density more faithful to the chromaticity of picture signals.

Although the foregoing explanation has been made of an embodiment in which the printing unit 2 of the picture printing device 10 is of the thermal transfer type, the picture printing device according to the present invention may be applied to e.g., a heat-sensitive or ink-jet printing system, without being limited to the thermal transfer printing system.

Figure 10:
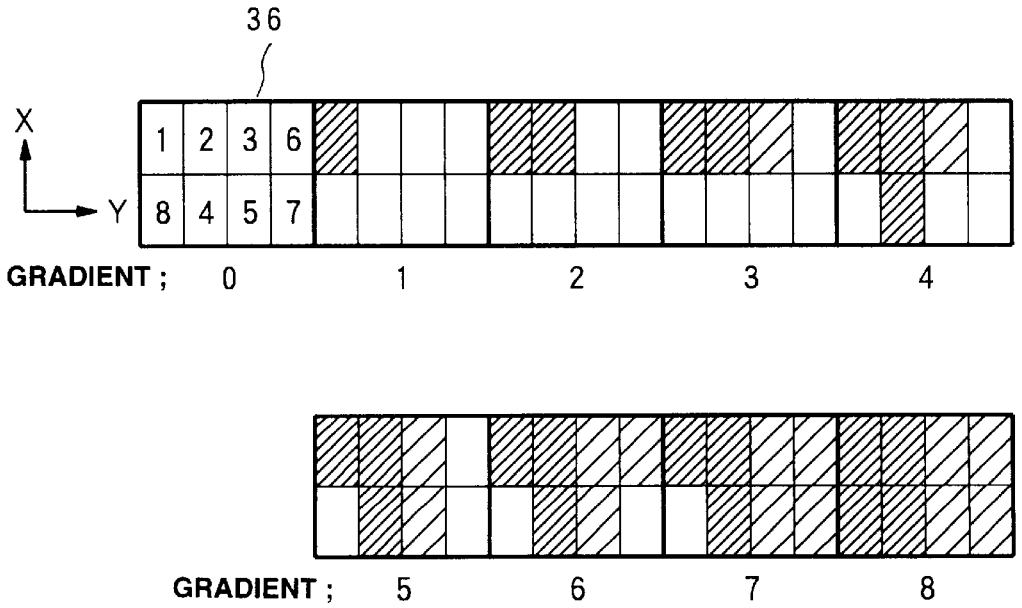
FIG. 10 shows an array of dots for respective gradients of a pixel printed by the picture printing device of the present invention, in which the print density is variably set every two lines and the pixel is formed by a 2×4 matrix.
Figure 11:
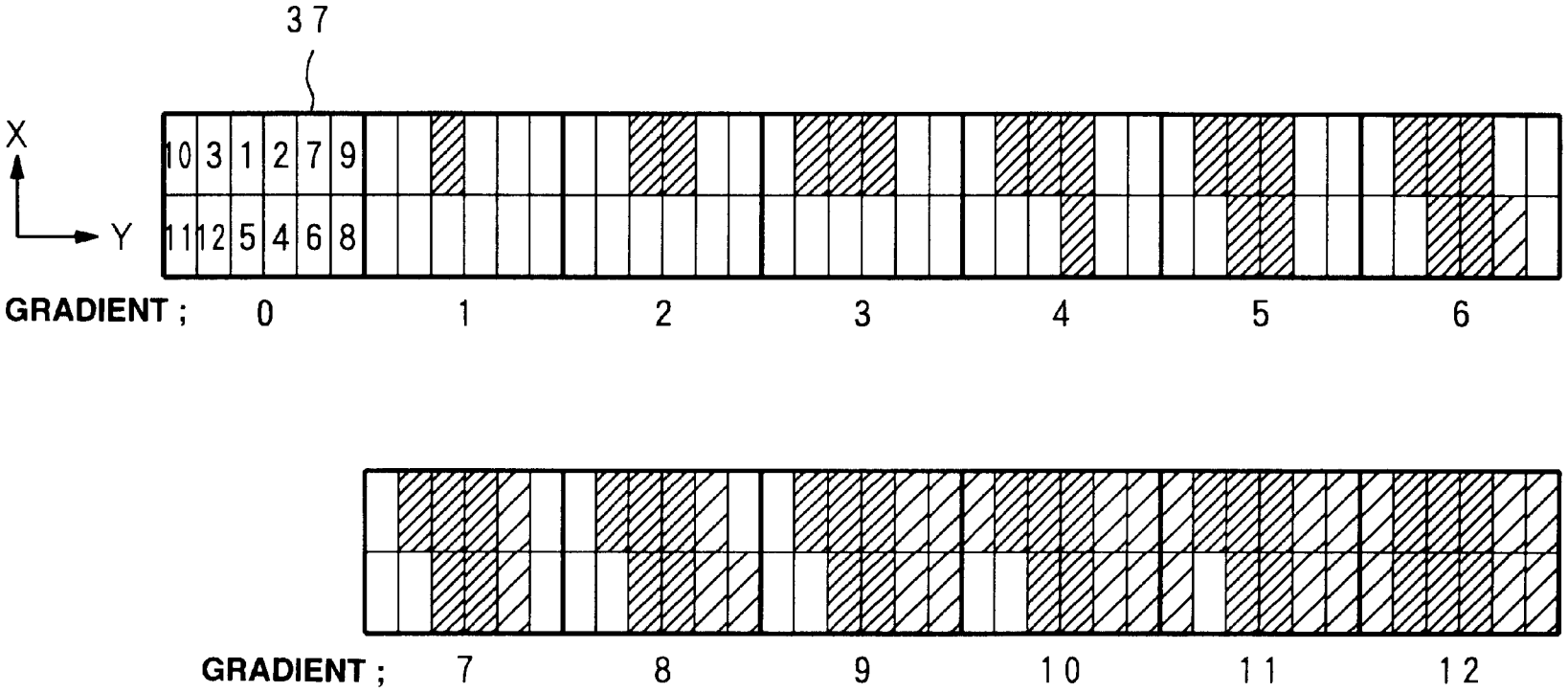
FIG. 11 shows an array of dots for respective gradients of a pixel printed by the picture printing device of the present invention, in which the print density is variably set every two lines and the pixel is formed by a 2×6 matrix.
Figure 12:
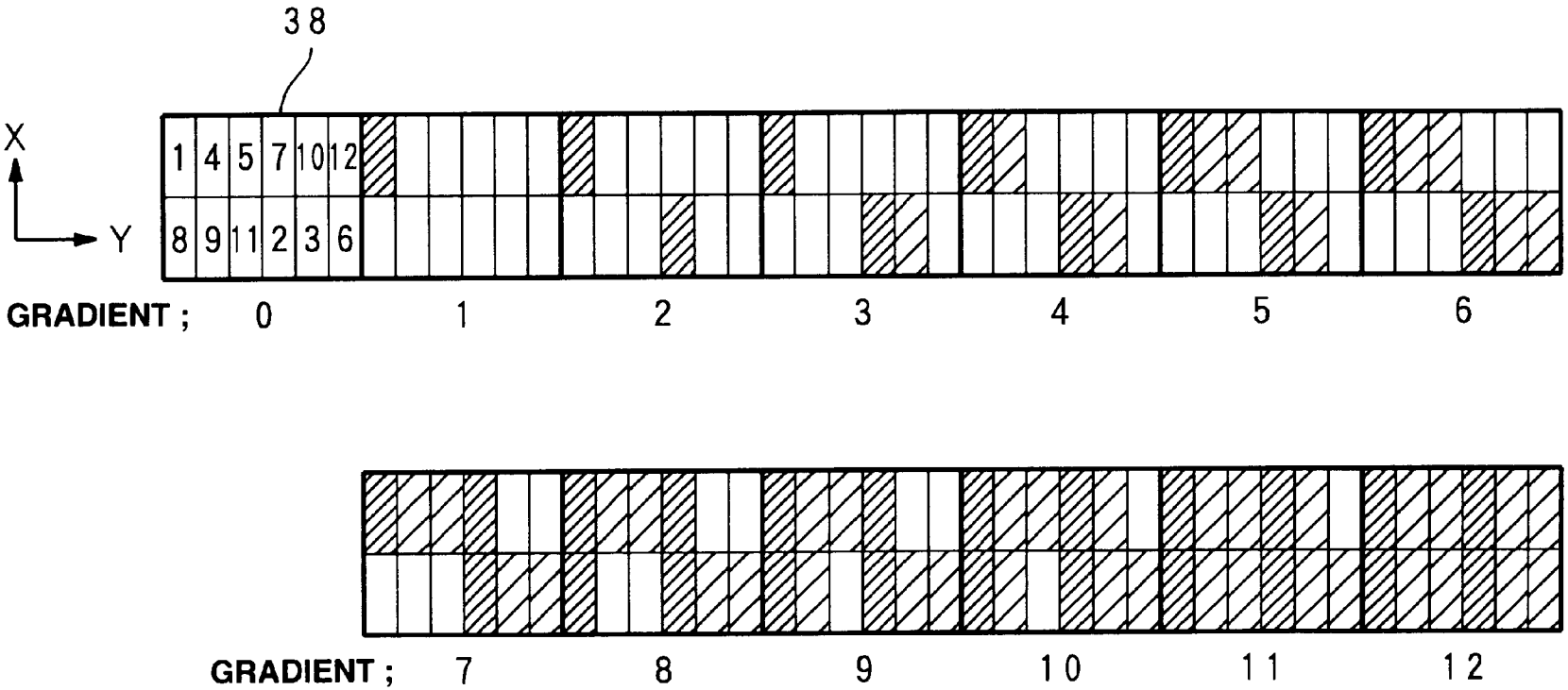
FIG. 12 shows an array of dots for respective gradients of a pixel printed by the picture printing device of the present invention, in which the print density is variably set every two lines and the pixel is formed by a 2×6 matrix different from the above 2×6 array.
Figure 13:
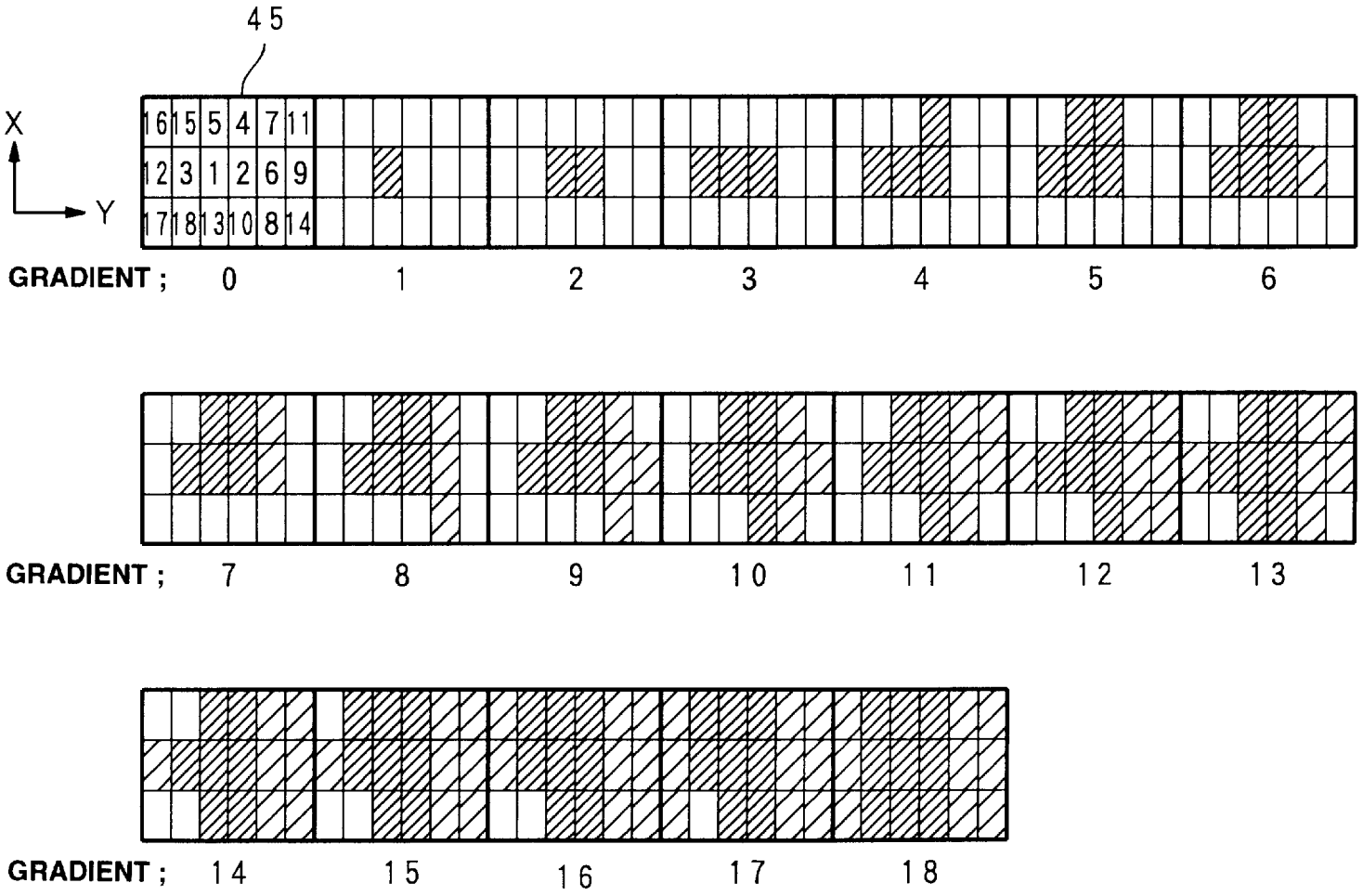
FIG. 13 shows an array of dots for respective gradients of a pixel printed by the picture printing device of the present invention, in which printing is carried out sequentially beginning from the center dot of a pixel and the pixel is formed by a 3×6 matrix.
Figure 14:
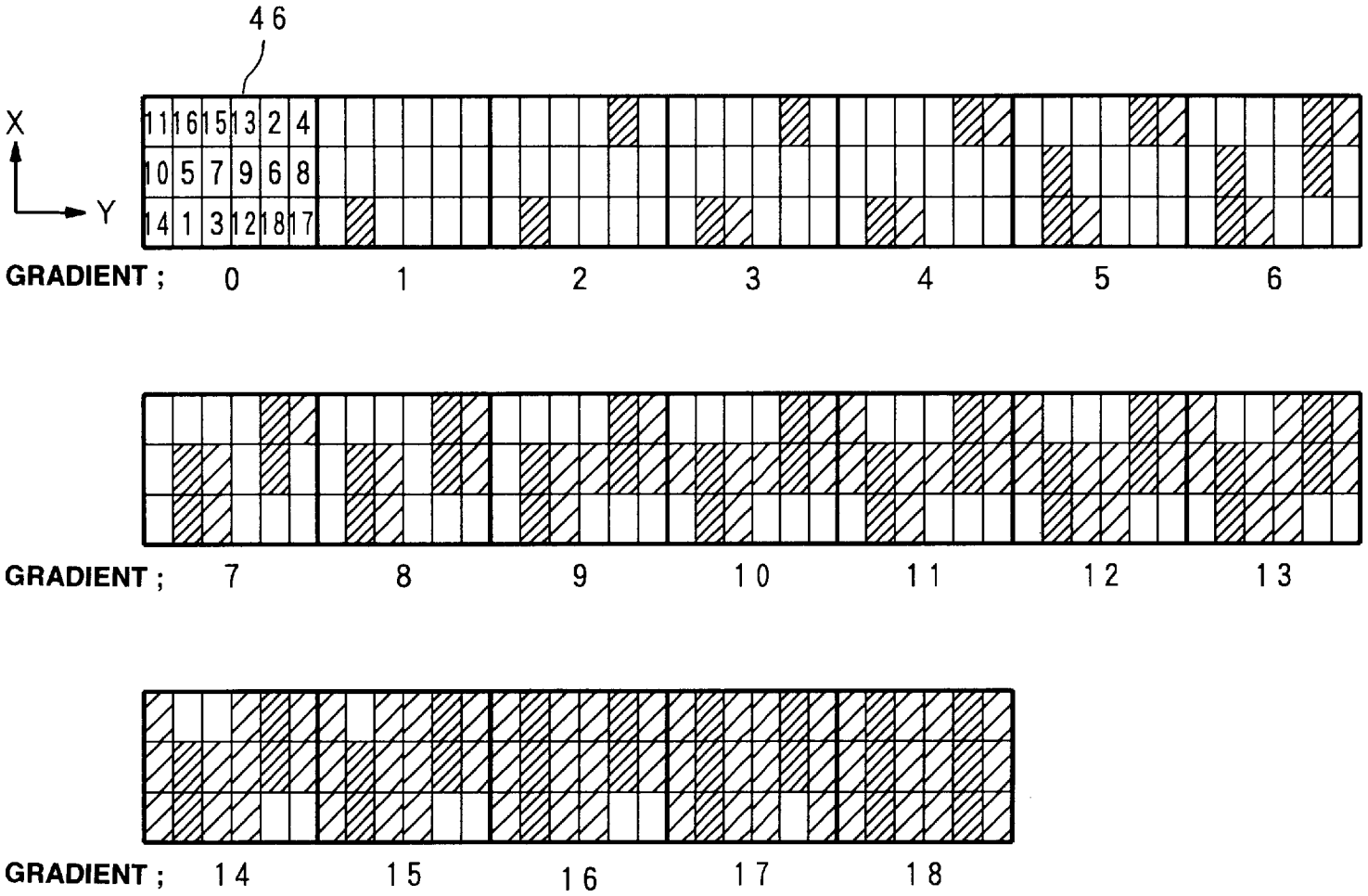
FIG. 14 shows an array of dots for respective gradients of a pixel printed by the picture printing device of the present invention, in which printing is carried out sequentially beginning from the peripheral dot of a pixel and the pixel is formed by a 3×6 matrix.
Figure 15:
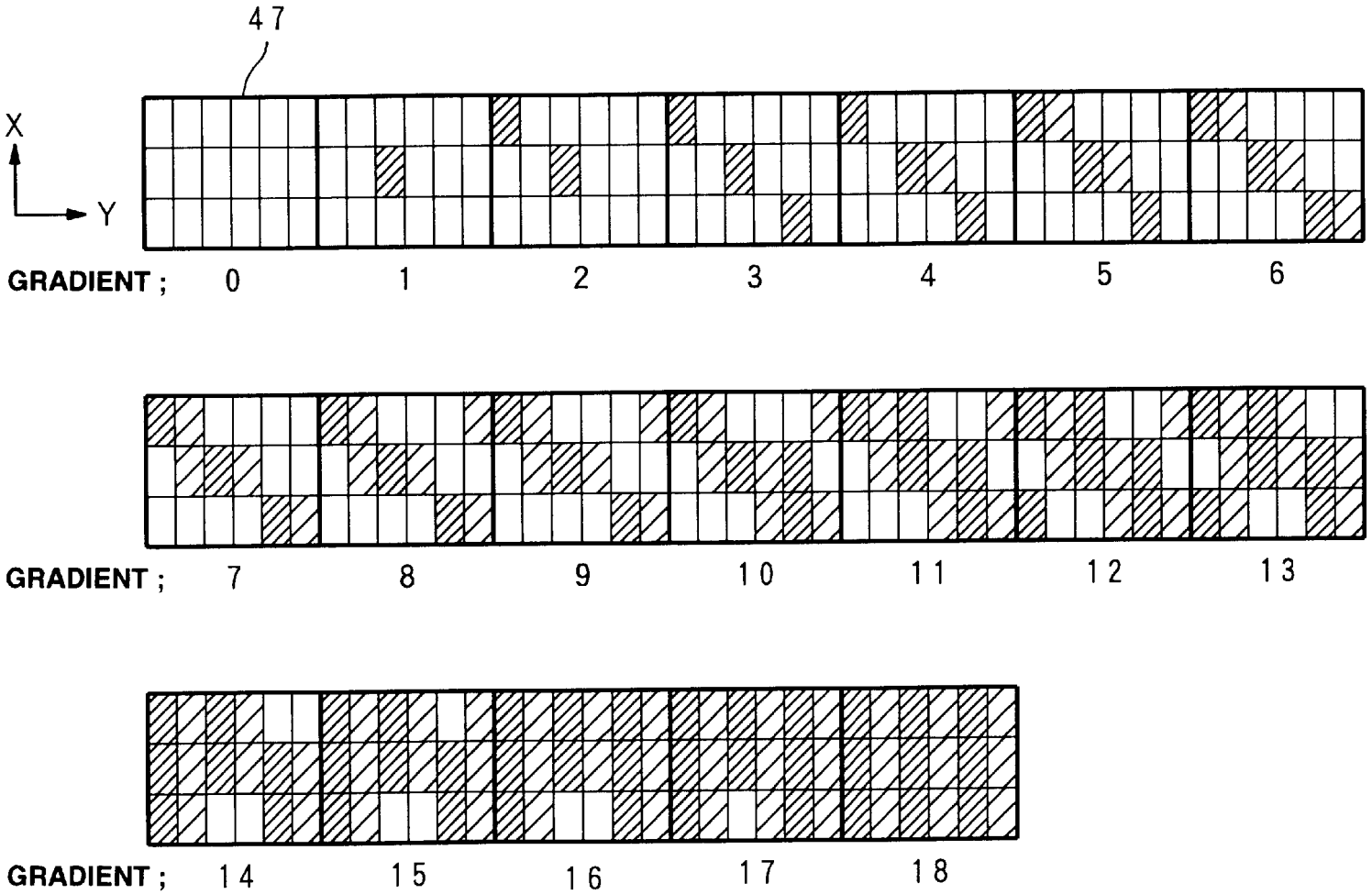
FIG. 15 shows an array of dots for respective gradients of a pixel printed by the picture printing device of the present invention, in which the print density is variably set line-by-line and the pixel is formed by a 3×6 matrix.

Also, the foregoing explanation has been made of the embodiment in which the positions of dots printed in the pixel 35 is set on the gradation basis and the standard print density and print density of 80% of the standard print density are used for printing even-numbered lines and odd-numbered lines, respectively, by the operation of the color conversion and color correction circuit 8, as shown in FIG. 5. However, the present invention is not limited to this dot position or line print density. For example, the present invention may also be applied to a case in which the positions of dots to be printed for the pixel 36 are set from one gradation to another and the standard print density and the print density of 80% of the standard density may be alternately employed for printing every two lines. Also, in the above-described embodiment of the picture printing device 10, each pixel 35 is formed by 2×4 dots. However, the present invention is not limited to this dot configuration, but is applicable to the case of FIG. 11 wherein each pixel 38 is made up of 2×6 dots, or to the cases of FIGS. 10, 14 or 15 wherein pixel 45, 46 or 47 is made up of 3×6 dots.

In addition, the foregoing description has been made of an embodiment in which two print densities, namely the standard print density and the print density of 80% of the standard print density, are used for printing by the color conversion and color correction circuit 8 of the picture printing device 10, as shown in FIG. 5. However, the present invention may also be applied to print density other than these print densities. Thus the print density may be set to three or more different values by optionally setting the pulse power of the strobe signals SR1, SR2, SR3 and SR4, without being limited to the above print density values.

What is claimed is:

1. A printing method comprising the step of printing a pixel, said pixel comprising an array of dot positions, said array having columns and rows;

wherein said printing a pixel comprises the steps of:

selectively printing dots at said dot positions of said array in accordance with a gradation of said pixel, and printing all the dots in a first column of said array at a different intensity level from the dots in a second adjacent column of said array.

2. A printing method as claimed in claim 1, wherein said printing dots at different intensity levels comprises printing dots at a first intensity level and a second intensity level, wherein said second intensity level is 80% of said first intensity level.

3. A printing method as claimed in claim 1, further comprising printing dots in every other column of said array at a different intensity level.

4. A printing method as claimed in claim 1, further comprising defining said array to consist of two rows and four columns thereby providing eight dot positions.

5. A printing method as claimed in claim 4, further comprising printing a dot in the first row, first column of said array for a pixel of a first gradation.

6. A printing method as claimed in claim 4, further comprising printing dots in the first row, first column; and second row, third column of said array for a pixel of a second gradation.

7. A printing method as claimed in claim 4, further comprising printing dots in the first row, first column; second row, third column; and first row, second column of said array for a pixel of a third gradation.

8. A printing method as claimed in claim 4 further comprising printing dots in the first row, first column; second row, third column; first row, second column; and second row, fourth column of said array for a pixel of a fourth gradation.

9. A printing method as claimed in claim 4, further comprising printing dots in the first row, first column; second row, third column; first row, second column; second row, fourth column; and first row, third column of said array for a pixel of a fifth gradation.

10. A printing method as claimed in claim 4, further comprising printing dots in the first row, first column; second row, third column; first row, second column; second row, fourth column; first row, third column; and second row, second column of said array for a pixel of a sixth gradation.

11. A printing method as claimed in claim 4, further comprising printing dots in the first row, first column; second row, third column; first row, second column; second row, fourth column; first row, third column; second row, second column; and first row, fourth column of said array for a pixel of a seventh gradation.

12. A printing method as claimed in claim 4, further comprising printing dots in the first row, first column; second row, third column; first row, second column; second row, fourth column; first row, third column; second row, second column; first row, fourth column; and second row, first column of said array for a pixel of an eighth gradation.

13. A printing method as claimed in claim 1, wherein said printing dots comprising printing dots of different colors.

14. A printing method as claimed in claim 1, wherein said printing dots further comprises alternating the intensity level at which all the dots in a column of said array are printed for every other column between a first intensity and a second intensity that is different from said first intensity.

15. A printing method as claimed in claim 1, wherein said printing dots further printing all the dots in said first column at a first intensity level and printing all the dots in said second column at a second intensity level.

16. A picture printing device comprising:

a print head for printing pixels, wherein each said pixel comprises one or more dots selectively printed in an array of dot positions, said array having columns and rows;

a gradation signal provided to said print head indicating a gradation for each pixel;

wherein said print head prints dots at said positions of said array in accordance with a gradation of said pixel; and further wherein said print head prints all the dots in a first column of said array at a different intensity level from the dots in a second adjacent column of said array.

17. A printing device as claimed in claim 16, wherein said different intensity levels comprise a first intensity level and a second intensity level, said second intensity level being 80% of said first intensity level.

18. A printing device as claimed in claim 16, wherein said print head prints dots in every other column of said array at a different intensity level.

19. A printing device as claimed in claim 16, wherein said array consists of two rows and four columns defining eight dot positions.

20. A printing device as claimed in claim 16, further comprising a memory unit for electronically storing a picture to be printed from a video signal input.

21. A printing device as claimed in claim 20, further comprising a display for displaying a picture from the video signal stored in said memory unit.

22. A printing device as claimed in claim 16, wherein said print head alternates the intensity level at which all the dots in a column of said array are printed for every other column between a first intensity and a second intensity that is different from said first intensity.

23. A printing device as claimed in claim 16, wherein said print head prints all the dots in said first column at a first intensity level and prints all the dots in said second column at a second intensity level.

* * * * *

UNITED STATES PATENT AND TRADEMARK OFFICE

CERTIFICATE OF CORRECTION

PATENT NO. : 6,007,175

DATED : December 28, 1999

INVENTOR(S) : Makoto TANAHASHI

It is certified that error appears in the above-identified patent and that said Letters Patent is hereby corrected as shown below:

Column 10, line 34 et seq., claim 20, line 1, should read;

20. A printing device as claimed in claim 16, further comprising a memory unit for electronically storing a video signal.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*